US008894049B2

(12) United States Patent
Ching

(10) Patent No.: US 8,894,049 B2
(45) Date of Patent: Nov. 25, 2014

(54) FAN HEATER WITH HUMIDIFIER

(75) Inventor: Chan Ching, New Taipei (TW)

(73) Assignee: Perfect Union Co., Ltd., New Taipei (TW)

( * ) Notice: Subject to any disclaimer, the term of this patent is extended or adjusted under 35 U.S.C. 154(b) by 385 days.

(21) Appl. No.: 13/495,207

(22) Filed: Jun. 13, 2012

(65) Prior Publication Data

US 2013/0334716 A1 Dec. 19, 2013

(51) Int. Cl.
*B01F 3/04* (2006.01)

(52) U.S. Cl.
USPC ..... 261/142; 261/30; 261/72.1; 261/81

(58) Field of Classification Search
USPC ..... 261/131, 137, 142, 152, 30, 72.1, 81, 261/DIG. 65
See application file for complete search history.

(56) References Cited

U.S. PATENT DOCUMENTS

| | | | | | |
|---|---|---|---|---|---|
| 1,821,297 | A * | 9/1931 | Driscoll | 165/60 |
| 1,981,916 | A * | 11/1934 | Huntley | 219/473 |
| 2,296,930 | A * | 9/1942 | Ihler | 119/319 |
| 2,631,831 | A * | 3/1953 | Robic | 261/30 |
| 3,105,892 | A * | 10/1963 | Knapp | 392/368 |
| 4,003,967 | A * | 1/1977 | Potvin | 261/30 |
| 4,752,423 | A * | 6/1988 | Wong | 261/142 |
| 5,693,266 | A * | 12/1997 | Jung | 261/142 |
| 6,220,579 | B1 * | 4/2001 | Chen | 261/131 |
| 6,755,398 | B1 * | 6/2004 | Wong | 261/81 |
| 2012/0112371 | A1 * | 5/2012 | Kanel et al. | 261/28 |

* cited by examiner

*Primary Examiner* — Charles Bushey
(74) *Attorney, Agent, or Firm* — Jackson IPG PLLC

(57) ABSTRACT

A fan heater with a humidifier includes a housing in which both a warm air generation mechanism for generating warm air and a humidification mechanism for generating a mist are provided. The fan heater with the humidifier is characterized by its integrated structure for effectively providing warm air and appropriate moisture at the same time, so as to prevent the air around the fan heater from being too dry.

5 Claims, 7 Drawing Sheets

FAN HEATER WITH HUMIDIFIER

BACKGROUND OF THE INVENTION

1. Technical Field

The present invention relates to a fan heater with a humidifier, wherein a warm air generation mechanism for generating warm air and a humidification mechanism for generating a mist are provided in the same housing to effectively supply warm air and appropriate moisture at the same time.

2. Description of Related Art

As the temperatures in many parts of the world can be intolerably low, the uncomfortable sensation of coldness has given rise to the development of electric heaters, fan heaters, and the like. While these products are intended to provide warmth to spaces of specific sizes, continued use of electric heaters or fan heaters indoors will make the air so dry that another kind of discomfort is felt. The overly dry air may irritate or even injure such sensitive organs as the skin and the mucous membrane.

Conventionally, fan heaters and humidifiers are separate devices independent of each other. A consumer tends to buy a fan heater first and will not consider buying a humidifier until a later time. However, whether the fan heater and the humidifier are purchased separately or at the same time, the additional cost of the humidifier is inevitable. The humidifier also occupies extra space.

The main structure of a conventional fan heater includes a quartz electric heating tube and a blower. The quartz electric heating tube serves as the heat source. The air generated by the blower blows over the heat source and becomes warm. The warm air is then output through an air outlet. Nevertheless, this structure has low heating efficiency due to the fact that the components near the quartz electric heating tube are subject to prolonged overheating and that the heat source cannot be released.

On the other hand, the main structure of a conventional humidifier includes a fixed humidifier main body, an atomizer, and a blower. The water stored in the humidifier main body is pumped to the atomizer where the water is gasified into a mist, and the mist is blown out of the humidifier by the blower. This structure, however, incurs high manufacturing costs and adds to the complexity of the control procedure of the humidifier. Besides, the water level in the humidifier cannot be known from the outside and can only be detected by the control unit. As such, the conventional humidifier leaves much room for improvement.

BRIEF SUMMARY OF THE INVENTION

In view of the above-mentioned defects of the conventional products, the present inventor conducted extensive research and experiment and finally succeeded in developing a fan heater with a humidifier as disclosed herein. The disclosed fan heater with the humidifier includes a housing in which both a warm air generation mechanism for generating warm air and a humidification mechanism for generating a mist are provided. The disclosed fan heater with the humidifier is characterized by its integrated structure for providing appropriate moisture while the fan heater is in operation, thus preventing the air around the fan heater from being excessively dry.

In the warm air generation mechanism of the present invention, a thermistor heating element and a quartz electric heating tube are located above a blower to provide a concentrated heat source and high heating efficiency. The air blown by the blower passes through the thermistor heating element and the quartz electric heating tube, and the resultant warm air is output through a warm air outlet.

In the humidification mechanism of the present invention, a humidifier mounting plate is provided at the back of the housing, and a humidifier main body is fastened to the mounting plate. The humidifier main body is provided with a water bottle connector on which a water-loaded water bottle can be placed upside down. The water in the water bottle flows into the humidifier main body under the control of a check valve and is gasified into a mist by an ultrasonic atomization module and a blower in the humidifier, wherein the blower also blows the mist out of the humidifier.

Overall, a compact structure is provided for effectively supplying warm air and appropriate moisture at the same time so that the air in the space where the fan heater with the humidifier is used will not be too dry.

DETAILED DESCRIPTION OF THE INVENTION

Figure 1:
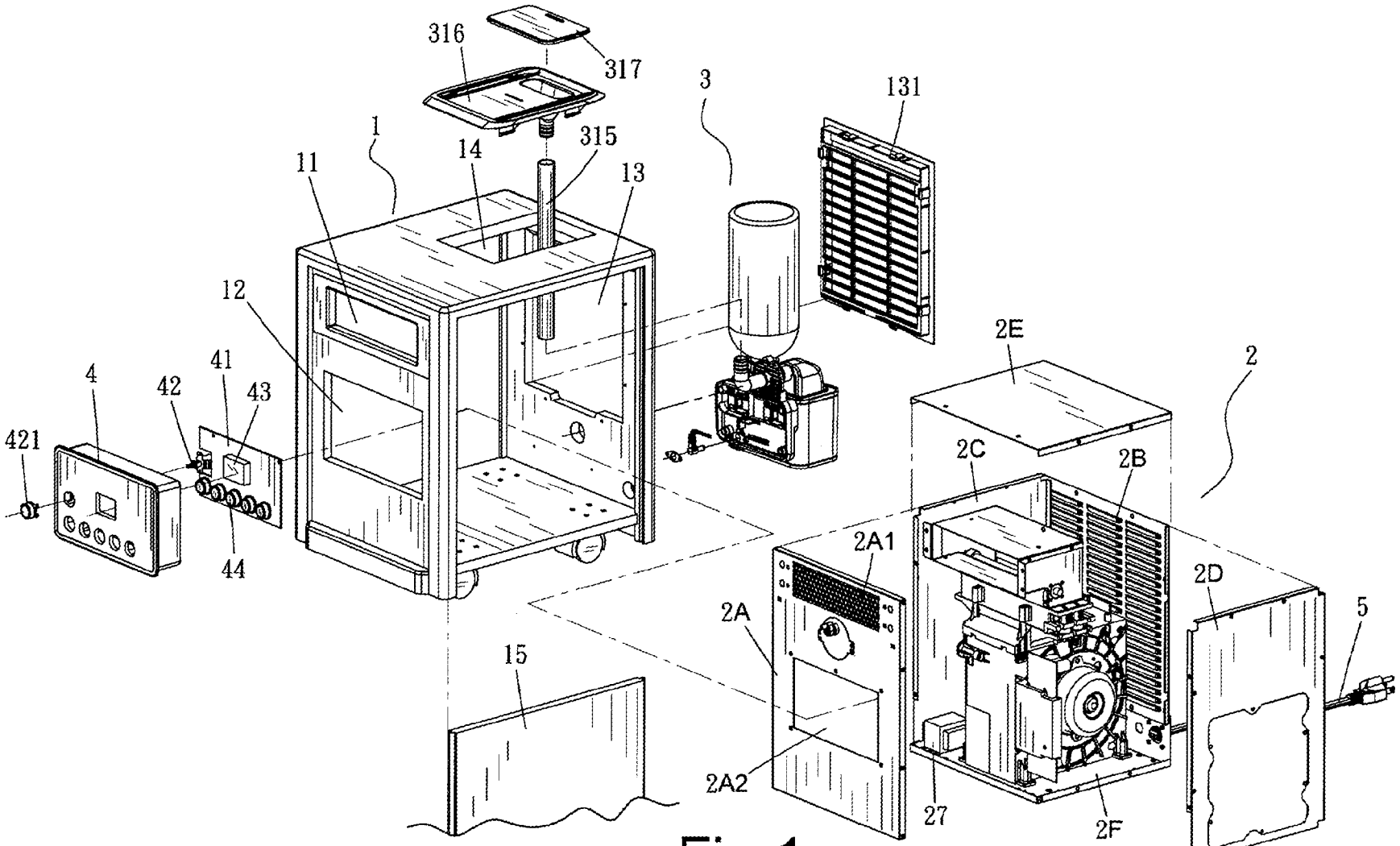
FIG. 1 is an exploded perspective view of the present invention.
Figure 2:
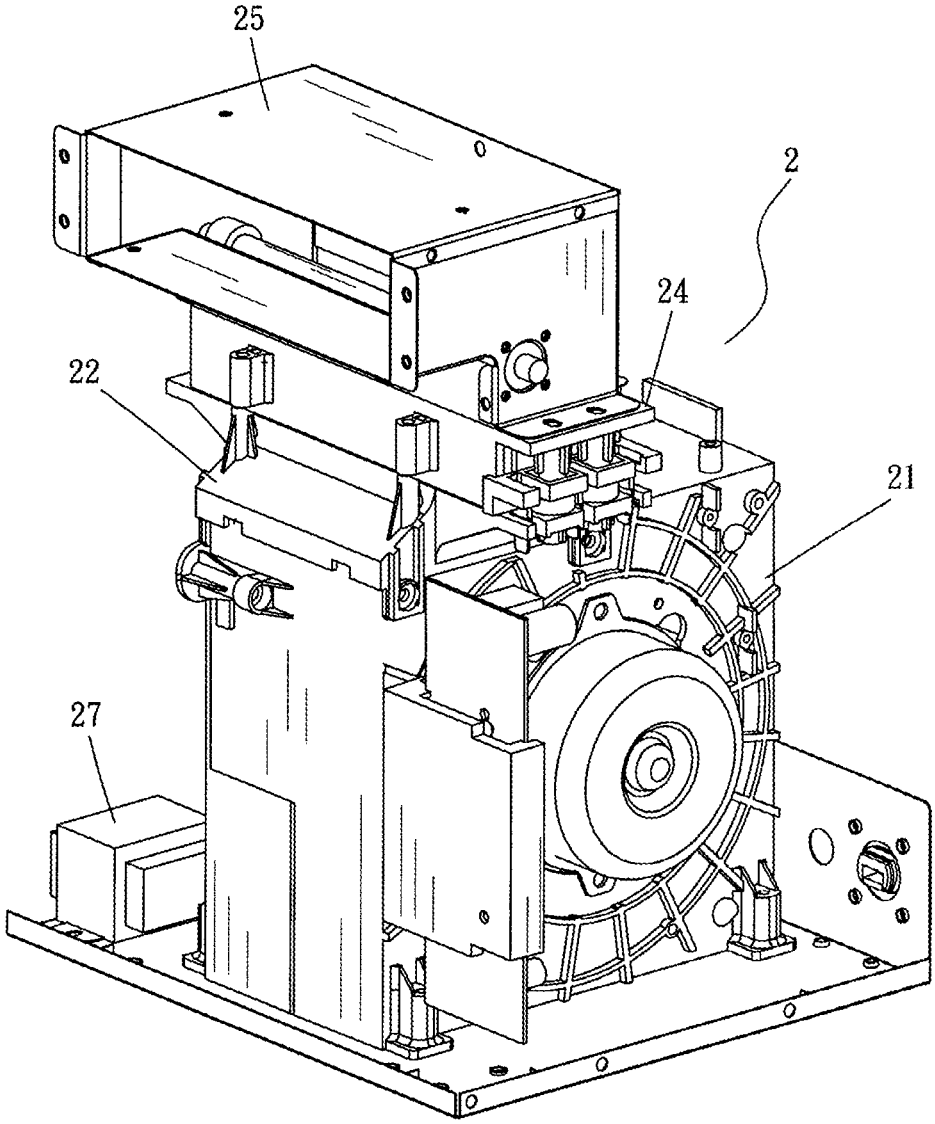
FIG. 2 is a perspective view of the warm air generation mechanism according to the present invention.
Figure 3:
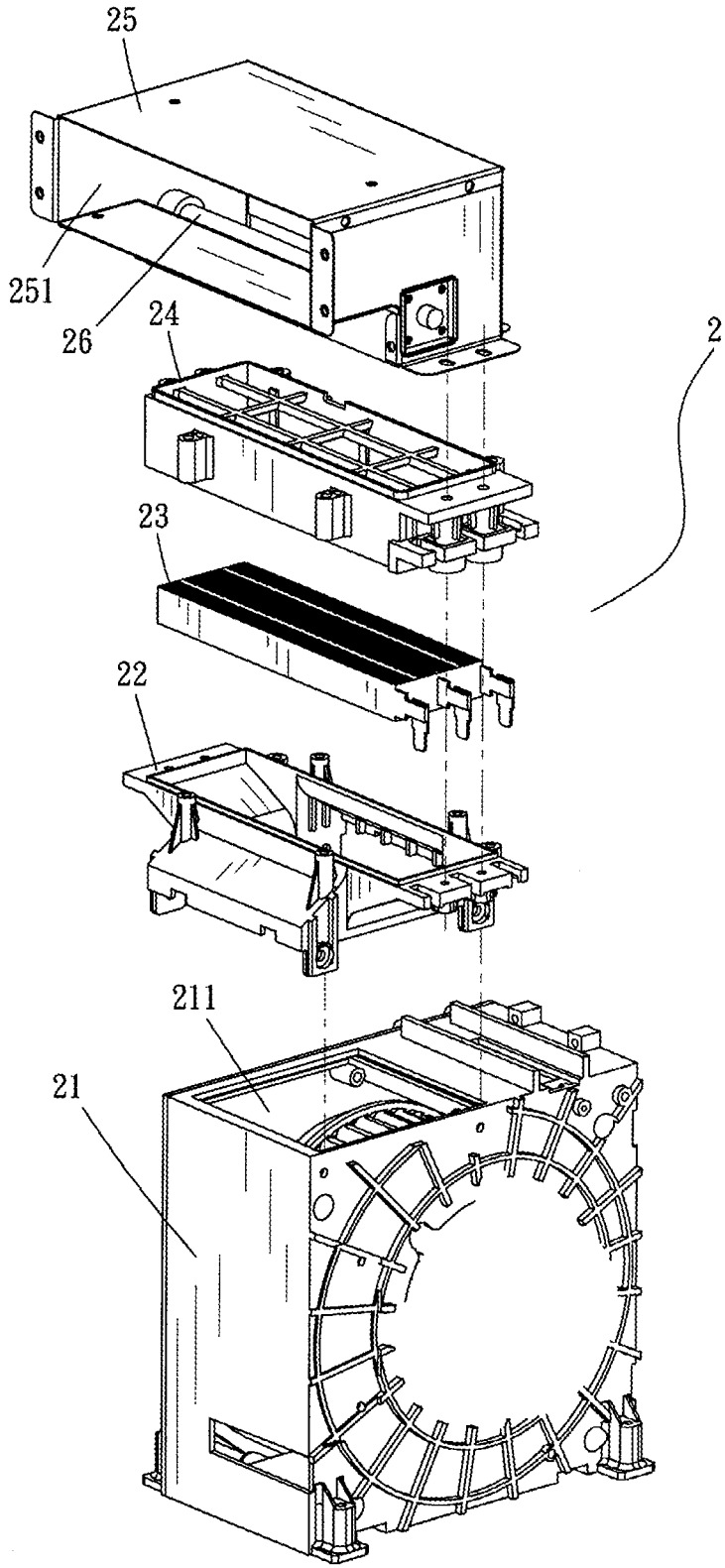
FIG. 3 is an exploded perspective view of the warm air generation mechanism according to the present invention.
Figure 5:
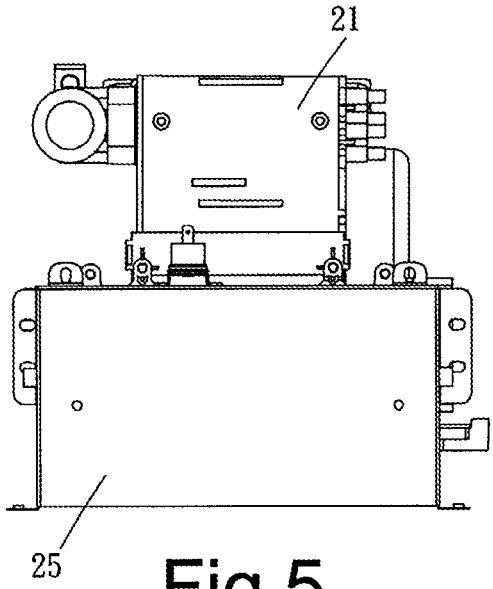
FIG. 5 is a top view of the warm air generation mechanism according to the present invention.
Figure 4:
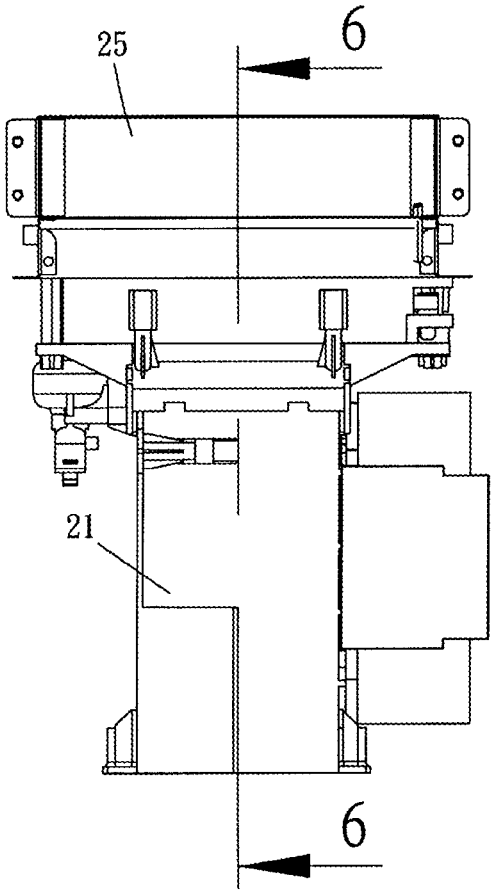
FIG. 4 is a front view of the warm air generation mechanism according to the present invention.
Figure 6:
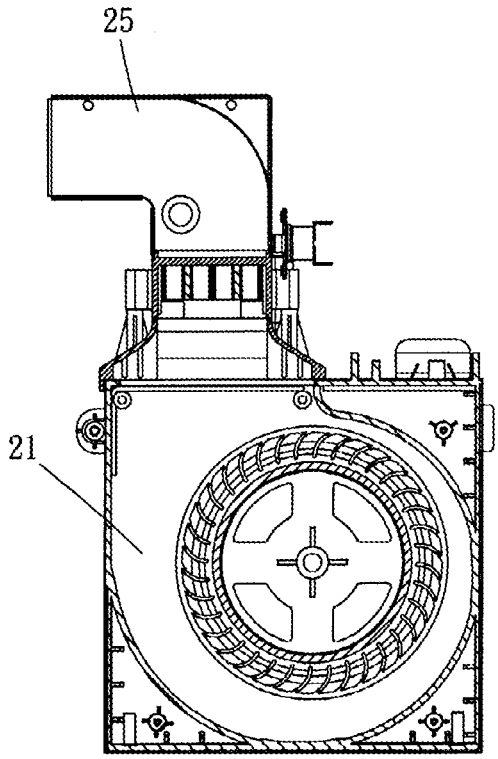
FIG. 6 is a cross-sectional view of the warm air generation mechanism according to the present invention.

Referring to FIG. 1, a fan heater with a humidifier as disclosed by the present invention essentially includes a housing 1, a warm air generation mechanism 2 provided in the housing 1, a humidification mechanism 3 provided in the housing 1, a control panel 4 provided on the front side of the housing 1, and an AC power cord 5.

As for the housing 1, a warm air outlet 11 and a control panel penetration hole 12 are provided at the front end, an air inlet 13 connected with a filter plate 131 is provided at the rear end, a mist outlet 14 is provided at the top end, and an openable inspection plate 15 is provided on one side.

The warm air generation mechanism 2 includes a fan heater case which is composed of a metallic front plate 2A, a rear ventilation plate 2B, a left-side plate 2C, a right-side plate 2D, a cover plate 2E, and a bottom plate 2F. The front plate 2A is provided with a wind mesh 2A1 and a control panel installation hole 2A2.

Referring to FIG. 1 through FIG. 6, a blower 21 is provided in the fan heater case of the warm air generation mechanism 2. An air guiding frame 22 is fixed to an air outlet 211 at an upper end of the blower 21. A thermistor heating element 23 is fixed in the air guiding frame 22. A heating element holder 24 is fixed above the air guiding frame 22. A warm air output frame 25 is connected to the heating element holder 24. A quartz electric heating tube 26 is provided in the warm air output frame 25. The warm air output frame 25 has a generally horizontal air guiding opening 251.

Figure 7:
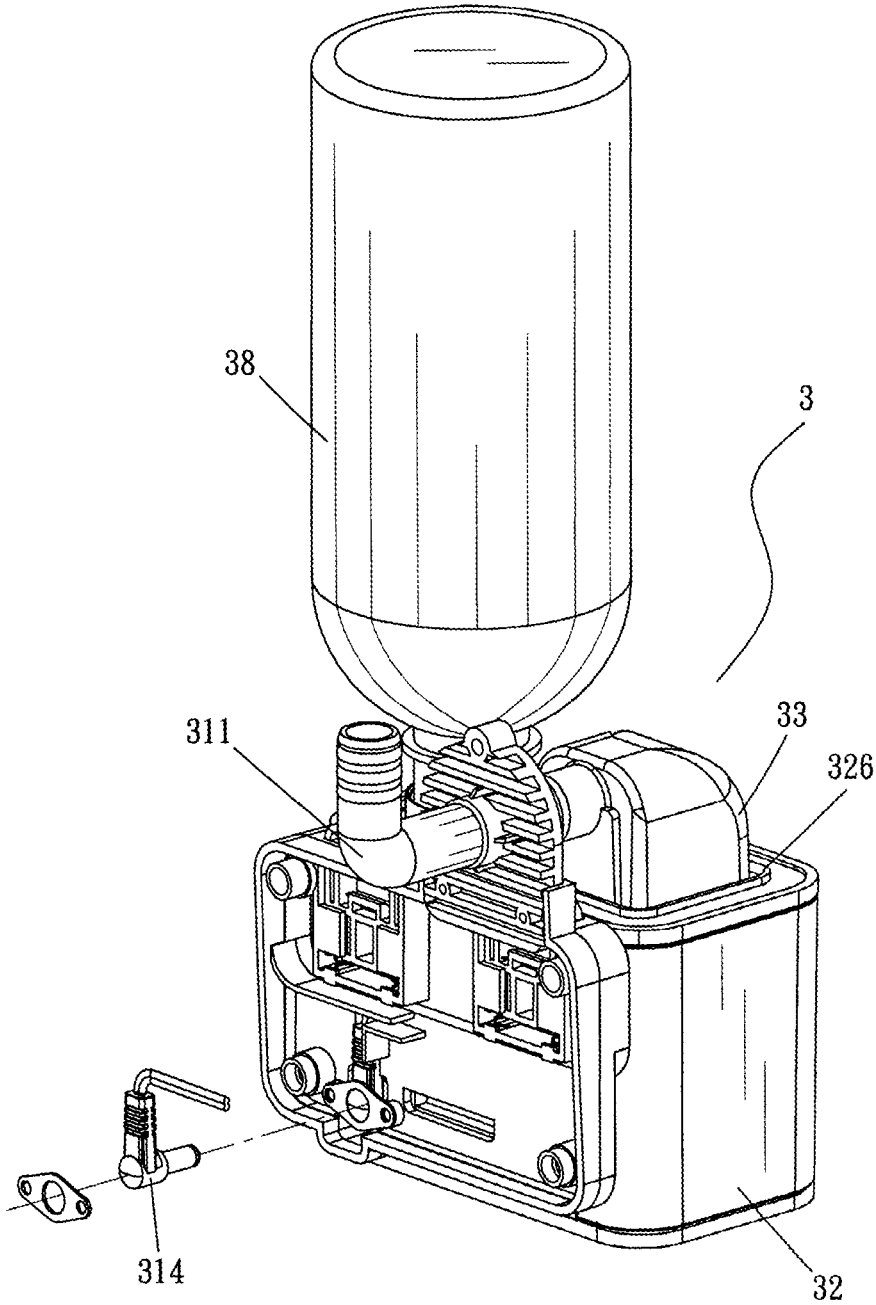
FIG. 7 is a perspective view of the humidification mechanism according to the present invention.
Figure 8:
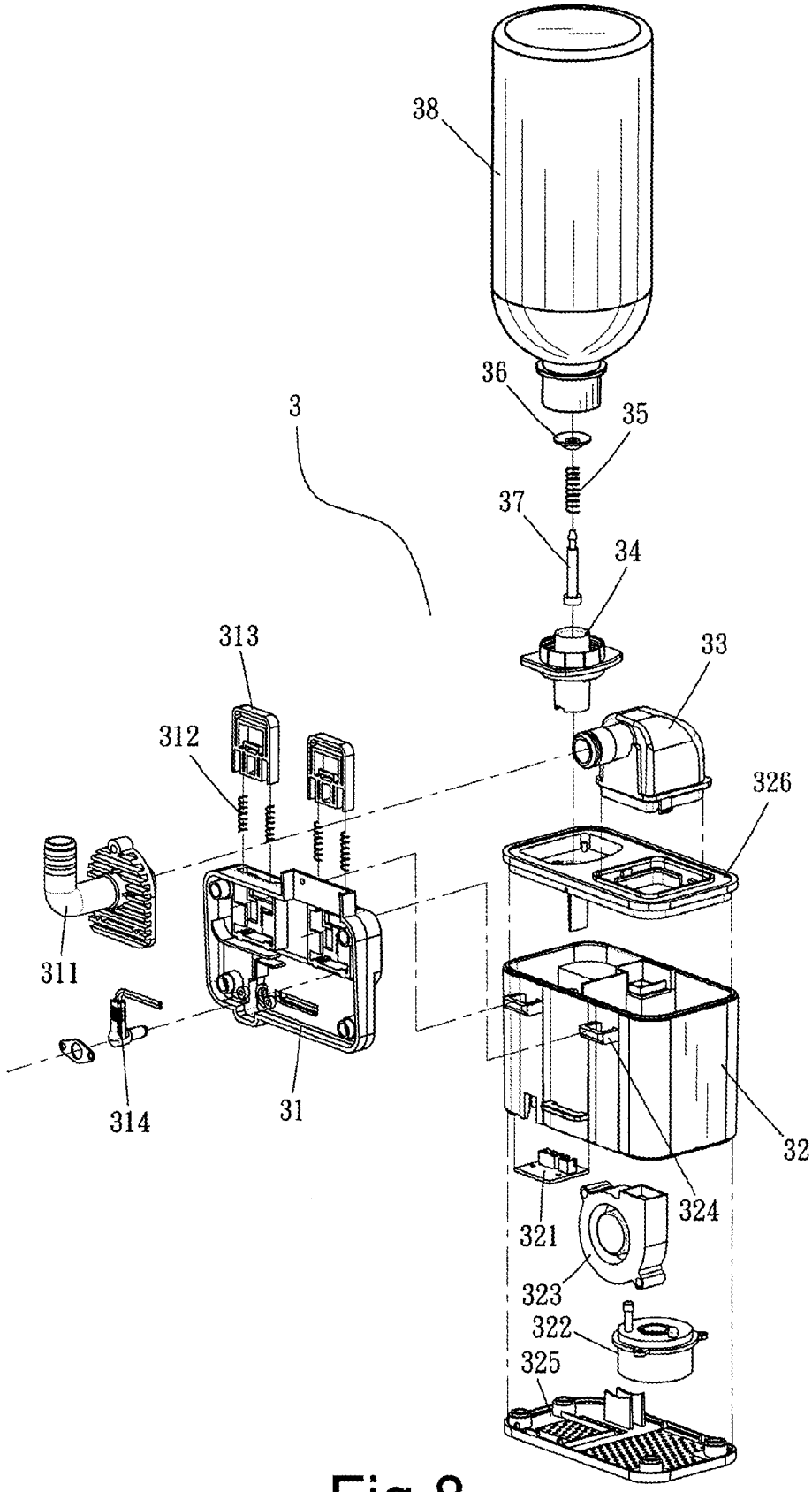
FIG. 8 is an exploded perspective view of the humidification mechanism according to the present invention.
Figure 9:
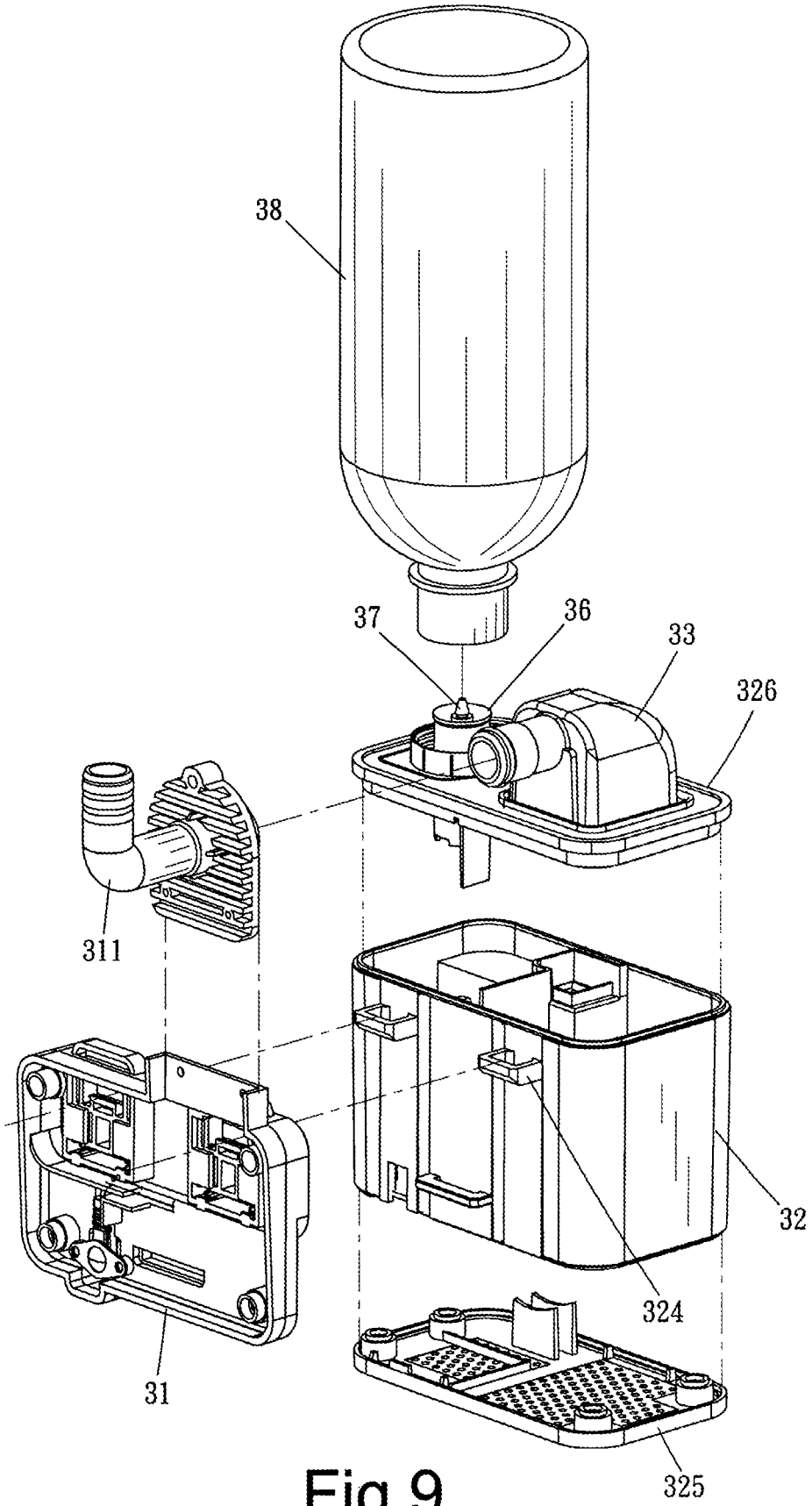
FIG. 9 is a partially exploded perspective view of the humidification mechanism according to the present invention.

Referring to FIG. 7 through FIG. 9, the humidification mechanism 3 includes a humidifier mounting plate 31 and a humidifier main body 32. The humidifier mounting plate 31 is fixed below the air inlet 13 at the rear end of the housing 1. An L-shaped adapter 311, a set of spring 312-loaded sliding fasteners 313, and a power supply connector 314 are provided on the humidifier mounting plate 31. As for the humidifier main body 32, fastening rings 324 are provided on the front side, and an upper cover 326 and a bottom plate 325 are fixed at the upper and the lower ends respectively. A power supply connection plate 321, an ultrasonic atomization module 322, and a brushless blower 323 are fixed inside the humidifier main body 32. The power supply connection plate 321 is electrically connected to the ultrasonic atomization module 322 and the brushless blower 323.

The upper cover 326 of the humidifier main body 32 is connected with a mist guiding tube connector 33 and a water bottle connector 34. A check valve 37 equipped with a spring 35 and a washer 36 is provided in the water bottle connector 34. A water bottle 38 can be placed upside down on the water bottle connector 34 so that the water in the water bottle 38 is introduced into the humidifier main body 32.

The fastening rings 324 on the front side of the humidifier main body 32 are inserted into the humidifier mounting plate 31 and are engaged with the sliding fasteners 313 respectively such that the humidifier main body 32 is connected to the humidifier mounting plate 31, with the power supply connector 314 electrically connected to the power supply connection plate 321.

The L-shaped adapter 311 is connected to a mist guiding tube 315 which, in turn, is connected to a mist-outlet top plate 316 provided at the mist outlet 14 of the housing 1. Thus, a humidifying mist can be output through the mist-outlet top plate 316. A mist-outlet sliding cover 317 is provided on the mist-outlet top plate 316.

A main circuit board 41 is fixed in the control panel 4 and includes a control circuit, a power switch 42, a display panel 43, and a plurality of adjustment knobs 44. The power switch 42, the display panel 43, and the adjustment knobs 44 are exposed on a surface of the control panel 4 so as to be directly operated by the user. A power button 421 is mounted around the power switch 42. The control panel 4 passes through the control panel penetration hole 12 at the front end of the housing 1 and is fixed at the control panel installation hole 2A2 on the front plate 2A of the warm air generation mechanism 2.

The AC power cord 5 is connected to a transformer 27 in warm air generation mechanism 2. The transformer 27 is connected to and supplies a transformed DC output power to the blower 21, the thermistor heating element 23, and the quartz electric heating tube 26 of the warm air generation mechanism 2. The transformer 27 also supplies the transformed DC output power to the ultrasonic atomization module 322 and the brushless blower 323 through the power supply connector 314 and the power supply connection plate 321.

In addition, the transformer 27 supplies the transformed DC output power to the main circuit board 41 of the control panel 4. The main circuit board 41 is connected to the blower 21, the thermistor heating element 23, and the quartz electric heating tube 26 of the warm air generation mechanism 2, and is connected via the power supply connector 314 and the power supply connection plate 321 to the ultrasonic atomization module 322 and the brushless blower 323. Operation of the above-mentioned electronic components can be controlled via the adjustment knobs 44 and the control circuit of the main circuit board 41.

In summary, the fan heater with the humidifier as described above can effectively provide warm air and appropriate moisture at the same time so that the air in the space where the fan heater with the humidifier is used will not be too dry.

What is claimed is:

1. A fan heater with a humidifier, essentially comprising:

a housing having a front end provided with a warm air outlet and a control panel penetration hole, a rear end provided with an air inlet connected with a filter plate, a top end provided with a mist outlet, and a side provided with an openable inspection plate;

a warm air generation mechanism provided in the housing, the warm air generation mechanism comprising a fan heater case, the fan heater case being composed of a metallic front plate, a rear ventilation plate, a left-side plate, a right-side plate, a cover plate, and a bottom plate, the front plate being provided with a wind mesh and a control panel installation hole, the fan heater case being provided therein with a blower, an air guiding frame being fixed to an air outlet at an upper end of the blower, a thermistor heating element being fixed in the air guiding frame, a heating element holder being fixed above the air guiding frame, a warm air output frame being connected to the heating element holder, a quartz electric heating tube being provided in the warm air output frame, the warm air output frame having a generally horizontal air guiding opening;

a humidification mechanism provided in the housing, the humidification mechanism comprising a humidifier mounting plate and a humidifier main body, the humidifier mounting plate being fixed below the air inlet at the rear end of the housing, the humidifier mounting plate being provided with an L-shaped adapter, a spring-loaded sliding fastener, and a power supply connector, the humidifier main body having a front side provided with a fastening ring, a top end fixed with an upper cover, and a lower end fixed with a bottom plate, wherein a power supply connection plate, an ultrasonic atomization module, and a brushless blower are fixed in the humidifier main body, the power supply connection plate being electrically connected to the ultrasonic atomization module and the brushless blower;

a control panel provided on a front side of the housing, a main circuit board being fixed in the control panel, the main circuit board comprising a control circuit, a power switch, a display panel, and a plurality of adjustment knobs, wherein the power switch, the display panel, and the adjustment knobs are exposed on a surface of the control panel so as to be directly operated by a user, a power button being mounted around the power switch, the control panel passing through the control panel penetration hole at the front end of the housing and being fixed at the control panel installation hole on the front plate of the warm air generation mechanism; and an AC power cord connected to a transformer in warm air generation mechanism, the transformer supplying a transformed DC output power to the blower, the thermistor heating element, and the quartz electric heating tube of the warm air generation mechanism and also to the ultrasonic atomization module and the brushless blower through the power supply connector and the power supply connection plate.

2. The fan heater with the humidifier as claimed in claim 1, wherein the upper cover of the humidifier main body is connected with a mist guiding tube connector and a water bottle connector, the water bottle connector being provided therein with a check valve, the check valve being equipped with a spring and a washer, wherein a water bottle can be placed upside down on the water bottle connector, allowing water in the water bottle to be introduced into the humidifier main body.

3. The fan heater with the humidifier as claimed in claim 1, wherein the fastening ring on the front side of the humidifier main body is inserted into the humidifier mounting plate and is engaged with the sliding fastener such that the humidifier main body is connected to the humidifier mounting plate and that the power supply connector is electrically connected to the power supply connection plate.

4. The fan heater with the humidifier as claimed in claim 1, wherein the L-shaped adapter is connected to a mist guiding tube and hence to a is mist-outlet top plate provided at the mist outlet of the housing such that a humidifying mist can be output through the mist-outlet top plate, there being a mist-outlet sliding cover provided on the mist-outlet top plate.

5. The fan heater with the humidifier as claimed in claim 1, wherein the transformer supplies the transformed DC output power to the main circuit board of the control panel, and the main circuit board is connected to the blower, the thermistor heating element, and the quartz electric heating tube of the warm air generation mechanism and is also connected to the ultrasonic atomization module and the brushless blower through the power supply connector and the power supply connection plate such that operation of the above-mentioned electronic components can be controlled through the adjustment knobs and the control circuit of the main circuit board.

* * * * *